US009996016B2

(12) United States Patent
Kiyono et al.

(10) Patent No.: US 9,996,016 B2
(45) Date of Patent: Jun. 12, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Fusako Kiyono, Kanagawa (JP); Shintaro Anno, Kanagawa (JP); Hiroki Ohmori, Kanagawa (JP); Emi Matsushita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/044,453

(22) Filed: Feb. 16, 2016

(65) Prior Publication Data

US 2017/0075239 A1 Mar. 16, 2017

(30) Foreign Application Priority Data

Sep. 16, 2015 (JP) ..... 2015-182711

(51) Int. Cl.

| | |
|---|---|
| ***G03G 9/097*** | (2006.01) |
| ***G03G 9/08*** | (2006.01) |
| ***G03G 9/087*** | (2006.01) |
| *G03G 15/08* | (2006.01) |

(52) U.S. Cl.

CPC ..... *G03G 9/08* (2013.01); *G03G 9/0819* (2013.01); *G03G 9/08755* (2013.01); *G03G 15/0865* (2013.01)

(58) Field of Classification Search

CPC ..... G03G 9/08773; G03G 9/09725; G03G 9/09733; G03G 9/09775

See application file for complete search history.

(56) References Cited

U.S. PATENT DOCUMENTS

2003/0091922 A1* 5/2003 Okado ..... G03G 9/08782 430/111.33
2008/0226998 A1* 9/2008 Ishii ..... G03G 9/0804 430/48
2008/0292367 A1 11/2008 Yamazaki et al.
2010/0092884 A1* 4/2010 Kumar ..... G03G 9/08708 430/108.11
2013/0323634 A1* 12/2013 Sugiura ..... G03G 9/0819 430/105

FOREIGN PATENT DOCUMENTS

JP H05-323653 A 12/1993
JP 2008-242422 A 10/2008
JP 5003433 B2 8/2012
JP 2014-115476 A 6/2014

OTHER PUBLICATIONS

Aerosil R 202 product sheet. https://www.aerosil.com/Ipa-productfinder/page/productsbytext/detail.html?pid=1866.*
Aerosil 208 product sheet. https://www.aerosil.com/Ipa-productfinder/page/productsbytext/detail.html?pid=1944&lang=en.*

* cited by examiner

*Primary Examiner* — Peter L Vajda
(74) *Attorney, Agent, or Firm* — Oliff PLC

(57) ABSTRACT

An electrostatic charge image developing toner includes toner mother particles containing at least a binder resin, elastomer particles including a first oil, and inorganic particles including a second oil, wherein a viscosity of the first oil is equal to or higher than a viscosity of the second oil.

15 Claims, 1 Drawing Sheet

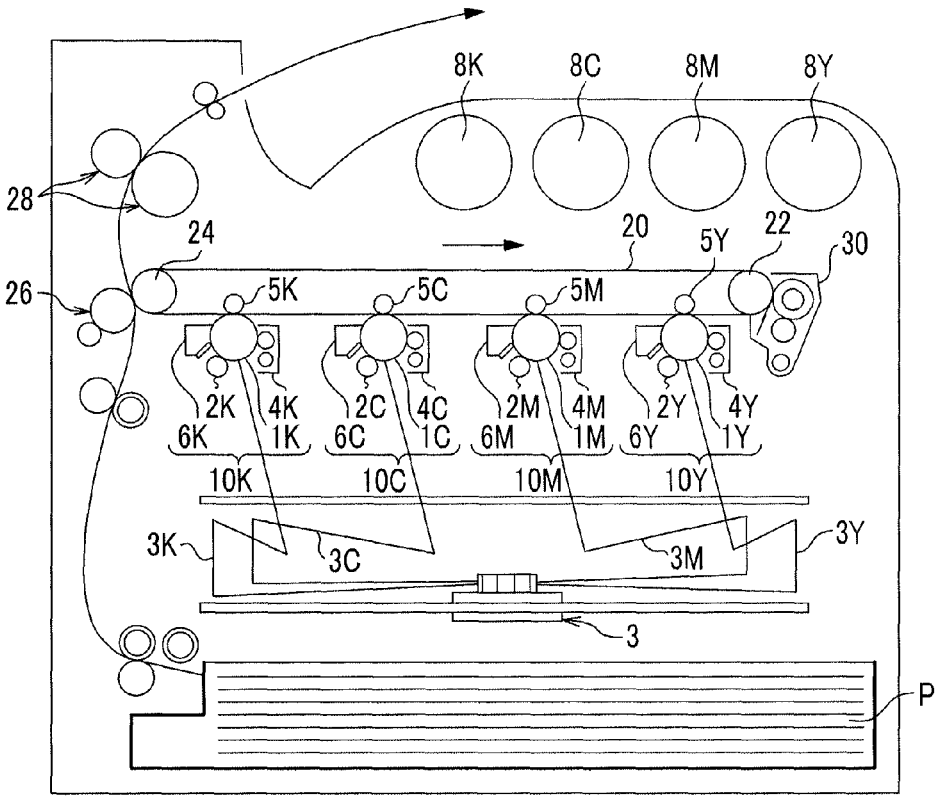
8K
8C
8M
8Y
28
24
20
5Y
22
30
26
5K
5C
5M
2K
4K
2C
4C
2M
4M
2Y
4Y
6K
1K
6C
1C
6M
1M
6Y
1Y
10K
10C
10M
10Y
3K
3C
3M
3Y
3
P

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-182711 filed Sep. 16, 2015.

BACKGROUND

1. Technical Field

The present invention relates to an electrostatic charge image developing toner, an electrostatic charge image developer, and a toner cartridge.

2. Related Art

A method of visualizing image information through an electrostatic charge image, such as electrophotography, is currently widely used in various fields. In electrophotography, an electrostatic charge image (electrostatic latent image) is formed on a photoreceptor (image holding member) through a charging exposure process, and the electrostatic latent image is developed using a developer containing a toner and visualized through a transfer process and a fixing process. Examples of the developer used herein include a two-component developer formed of a toner and a carrier and a single-component developer such as magnetic toner or non-magnetic toner in which a toner is singly used. As a preparing method of the toner, a kneading and pulverizing method of melting and kneading a thermoplastic resin with a pigment, a charge-controlling agent, and a release agent such as wax, and cooling, finely pulverizing, and further classifying the resultant is generally used. In the toner, inorganic or organic particles for improving fluidity or cleaning properties may be added to the surface of the toner mother particles, if necessary.

SUMMARY

According to an aspect of the invention, there is provided an electrostatic charge image developing toner including:

toner mother particles containing at least a binder resin;

elastomer particles including a first oil; and inorganic particles including a second oil, wherein a viscosity of the first oil is equal to or higher than the viscosity of the second oil.

BRIEF DESCRIPTION OF THE DRAWING

Exemplary embodiments of the present invention will be described in detail based on the following FIGURES, wherein:

FIG. 1 is a schematic configuration diagram showing an example of an image forming apparatus which is preferably used in the exemplary embodiment.

DETAILED DESCRIPTION

Hereinafter, the exemplary embodiments will be described.

In the following description, the expression "A to B" indicating a range of numerical values has the same meaning as the expression "equal to or greater than A and equal to or smaller than B" and means a range of numerical values including A and B which are end points, unless specifically noted.

Electrostatic Charge Image Developing Toner

An electrostatic charge image developing toner according to the exemplary embodiment (may be also simply referred to as a "toner") includes toner mother particles containing at least a binder resin, elastomer particles including a first oil, and inorganic particles including a second oil, and viscosity of the first oil is equal to or higher than viscosity of the second oil.

As a result of research of the inventors, it is found that it is necessary to stabilize loads applied to a cleaning blade, in order to increase the life time of a cleaning system using a cleaning blade.

In addition, it is found that, the loads applied to the cleaning blade change depending on a friction force between a photoreceptor and a blade and an amount of an isolated external additive passing a blade nip and it is effective to supply oil having an oil component treated with an external additive to the photoreceptor, in order to control both of the friction force and the amount of external additive.

As a result of further research of the inventors, it is found that an image in which passing of a toner and formation of white streaks are prevented is obtained by using an electrostatic charge image developing toner including toner mother particles containing at least a binder resin, elastomer particles including a first oil, and inorganic particles including a second oil, in which viscosity of the first oil is equal to or higher than viscosity of the second oil. In addition, it is found the effects according to the exemplary embodiment are exhibited even when the printing environment such as a temperature or humidity at the time of printing changes or even when image density of an image to be formed remarkably changes.

The specific mechanism is not clear but it is assumed as follows. The electrostatic charge image developing toner of the exemplary embodiment includes elastomer particles including a first oil and inorganic particles including a second oil, in which viscosity of the first oil is equal to or higher than viscosity of the second oil, and accordingly, in conditions where comparatively low physical stress is applied in a developing device, the first oil hardly bleeds out from the elastomer particles, and in conditions where comparatively high physical stress is applied to a cleaning blade part, the second oil included in the inorganic particles functions as priming water and makes the first oil easily bleed out. As a result, it is found that, bleeding properties of the oil from the elastomer particles at the time of printing are high in the cleaning blade portion compared to those in the developing device, loads applied to the cleaning blade is stably maintained, and an image in which passing of a toner and formation of white streaks are prevented is obtained, even when the printing environment such as a temperature or humidity at the time of printing changes or even when image density of an image to be formed remarkably changes.

Toner Mother Particles

The toner mother particles of the exemplary embodiment contain a binder resin. In addition to the above component, the toner mother particles may contain a colorant, a release agent, and other components.

Binder Resin

The toner mother particles of the exemplary embodiment contain a binder resin.

The binder resin is not particularly limited, but examples thereof include a homopolymer consisting of monomers such as styrenes such as styrene, p-chlorostyrene, or α-methyl styrene; esters including a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate; vinyl nitriles such as acrylonitrile or methacrylonitrile; vinyl ethers such as vinyl methyl ether or vinyl isobutyl ether; vinyl ketones such as vinyl methyl ketone, vinyl ethyl ketone, or vinyl isopropenyl ketone; polyolefins such as ethylene, propylene, or butadiene, or a copolymer obtained by combining two or more kinds of these monomers, or a mixture of these. Examples of the binder resin include a non-vinyl condensation resin such as an epoxy resin, a polyester resin, a polyurethane resin, a polyamide resin, a cellulose resin, or a polyether resin, a mixture of these and the vinyl resin, or a graft polymer obtained by polymerizing a vinyl monomer in the presence thereof.

Among these, a polyester resin is preferably used.

A styrene resin, a (meth)acrylic resin, and a styrene-(meth)acrylic copolymer resin are, for example, obtained by a well-known method by using a styrene monomer or a (meth)acrylic acid monomer alone or in combination. The term "(meth)acrylic" is an expression including both "acrylic" and "methacrylic".

A polyester resin is obtained by selecting and incorporating preferable materials from polyvalent carboxylic acid and polyvalent diol and performing synthesizing using a well-known method of the related art such as an ester interchange method or a polycondensation method.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic dials are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is determined by a DSC curve obtained by differential scanning calorimetry (DSC), and more specifically, is determined by "extrapolation glass transition starting temperature" disclosed in a method of determining the glass transition temperature of JIS K7121-1987 "Testing Methods for Transition Temperature of Plastics".

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed with a THF solvent using GPC • HLC-8120 GPC manufactured by Tosoh Corporation as a measurement device and using a column TSKgel Super HM-M (15 cm) manufactured by Tosoh Corporation. The weight average molecular weight and the number average molecular weight are calculated using a calibration curve of molecular weight created with a monodisperse polystyrene standard sample from results of this measurement.

A known preparing method is applied to prepare the polyester resin. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is, for example, preferably from 40% by weight to 95% by weight, more preferably from 50% by weight to 90% by weight, and even more preferably from 60% by weight to 85% by weight with respect to a total amount of toner mother particles.

Colorant

The toner mother particles preferably contain a colorant.

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

In the exemplary embodiment, the content of the colorant in the toner mother particles is preferably from 1 part by weight to 30 parts by weight, and more preferably from 3 parts by weight to 15 parts by weight with respect to 100 parts by weight of the binder resin.

In addition, it is also effective to use a surface-treated colorant or use a pigment dispersing agent. A yellow toner, a magenta toner, a cyan toner, or a black toner is prepared by selecting the type of colorant.

Release Agent

Examples of the release agent include, hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from "melting peak temperature" described in the method of obtaining a melting temperature in JIS K7121-1987 "Testing Methods for Transition Temperatures of Plastics", from a DSC curve obtained by differential scanning calorimetry (DSC).

The content of the release agent is, for example, preferably from 1% by weight to 20% by weight, and more preferably from 5% by weight to 15% by weight with respect to a total amount of the toner mother particles.

Other Additives

In addition to the components described above, various components such as an internal additive and a charge-controlling agent may be added to the toner mother particles according to the exemplary embodiment, if necessary.

Examples of the internal additive include metal such as ferrite, magnetite, reduced iron, cobalt, nickel, and manganese, alloy, or a magnetic member such as a compound including the metals.

Examples of the charge-controlling agent include a dye formed of a complex such as a quaternary ammonium salt compound, a nigrosine compound, aluminum, iron, and chrome, and a triphenylmethane pigment.

Characteristics of Toner Mother Particles

The toner mother particles may be toner mother particles having a single-layer structure, or toner mother particles having a so-called core/shell structure composed of a core part (core particle) and a coating layer (shell layer) coated on the core part.

Here, toner mother particles having a core/shell structure is preferably composed of, for example, a core part containing a binder resin, and if necessary, other additives such as a colorant and a release agent and a coating layer containing a binder resin.

The volume average particle diameter ($D_{50VT}$) of the toner mother particles is preferably from 2 μm to 10 μm, and more preferably from 4 μm to 8 μm.

Various average particle diameters and various particle size distribution indices of the toner mother particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter $D_{16v}$ and a number average particle diameter $D_{16p}$, while the particle diameter when the cumulative percentage becomes 50% is defined as that corresponding to a volume average particle diameter $D_{50v}$ and a number average particle diameter $D_{50p}$. Furthermore, the particle diameter when the cumulative percentage becomes 84% is defined as that corresponding to a volume average particle diameter $D_{84v}$ and a number average particle diameter $D_{84p}$.

Using these, a volume average particle size distribution index (GSDv) is calculated as $(D_{84v}/D_{16v})^{1/2}$, while a number average particle size distribution index (GSDp) is calculated as $(D_{84p}/D_{16p})^{1/2}$.

The shape factor SF1 of the toner mother particles is preferably from 110 to 150, and more preferably from 120 to 140.

The shape factor SF1 is obtained through the following expression.

$$SF1=(ML^2/A)\times(\pi/4)\times 100 \qquad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

External Additive

The electrostatic charge image developing toner of the exemplary embodiment contains elastomer particles including a first oil and inorganic particles including a second oil.

Elastomer Particles

The electrostatic charge image developing toner of the exemplary embodiment contains the elastomer particles including the first oil.

First Oil

The viscosity of the first oil used in the exemplary embodiment is equal to or higher than the viscosity of the second oil which will be described later.

In the exemplary embodiment, the viscosity of the first oil and the second oil is viscosity obtained by separating each of the first oil and the second oil from the toner and measuring the viscosity at 25° C. using RS-CPS Plus manufactured by BROOKFIELD.

The viscosity of the first oil at 25° C. is preferably from 10 mPa·s to 500 mPa·s and more preferably from 30 mPa·s to 300 mPa·s.

By setting the viscosity to be equal to or smaller than the upper limit, the release properties between the toner image and a member such as the image holding member are excellently exhibited. Meanwhile, by setting the viscosity to be equal to or greater than the lower limit, stable oil seeping properties are exhibited with the pressure from a regulating member (trimmer) of a development device.

As the first oil contained in the elastomer particles, a compound having a melting point lower than 20° C., that is, a compound which is liquid at 20° C. may be used, and well-known various silicone oil or lubricant is exemplified. In addition, a boiling point of the first oil is preferably equal to or higher than 150° C. and more preferably equal to or higher than 200° C.

As the first oil, silicone oil is preferable.

Examples of silicone oil include silicone oil such as dimethyl polysiloxane, diphenyl polysiloxane, and phenyl methyl polysiloxane, and reactive silicone oil such as amino-modified polysiloxane, epoxy-modified polysiloxane, carboxyl-modified polysiloxane, carbinol modified polysiloxane, fluorine-modified polysiloxane, methacryl-modified polysiloxane, mercapto-modified polysiloxane, and phenol modified polysiloxane. Among these, dimethyl polysiloxane (also referred to as "dimethyl silicone oil") is more preferable.

In addition, as the first oil, oil having a reverse polarity to the inorganic particles (external additive) including the second oil which will be described later may be used. Examples of oil having a reverse polarity to the inorganic particles include oil having positive charging properties such as monoamine-modified silicone oils, diamine-modified silicone oil, amino-modified silicone oil, and ammonium modified silicone oil; and oil having negative charging properties such as dimethyl silicone oil, alkyl-modified silicone oil, α-methyl sulfone-modified silicone oil, chlorophenyl silicone oil, and fluorine-modified silicone oil.

In addition, as the first oil contained in the elastomer particles, oil which is the same type as the second oil contained in the inorganic particles is preferably used and oil which is the same type as the second oil contained in the inorganic particles and has different weight average molecular weight is more preferably used. Specifically, as the same type of oil, oil in which 90 mol % or more of monomers as raw materials are the same is preferable, and a repeating unit included in a molecular chain, 90 mol % or more of which is the same, is preferable as a molecular structure of the oil.

By using the oil which is the same type as the second oil contained in the inorganic particles and has a great molecular weight, as the first oil contained in the elastomer particles, a configuration in which the viscosity of the first oil is equal to or higher than the viscosity of the second oil is provided.

By using the same type of oil in the elastomer particles and the inorganic particles, an electrostatic charge image developing toner which obtains an image in which passing of a toner and formation of white streaks are further prevented is obtained. It is assumed that the above effect is obtained because excellent conformability of both oil items is obtained and bleeding of the oil with high physical stress is promoted.

The oil items which are the same type and have different molecular weights, also have different temperature dependability of viscosity, when a molecular weight is small, the viscosity at a higher temperature is easily deteriorated. In an image forming apparatus, a temperature is easily increased due to the driving of the apparatus and may reach a temperature equal to or higher than 50° C. In the image forming apparatus at such a high temperature, the oil having a greater molecular weight, that is, the first oil contained in the elastomer particles has the viscosity which rarely changes. Accordingly, it is assumed that, even in an environment where a temperature changes, a stable amount of oil is supplied to the cleaning blade portion and as a result, passing of a toner to be obtained and formation of white streaks are further prevented.

A weight average molecular weight of the first oil is preferably from 2,000 to 30,000, more preferably from 3,000 to 25,000, and even more preferably from 6,000 to 20,000.

The weight average molecular weight of the first oil and the second oil is measured and calculated by gel permeation chromatography (GPC). Specifically, the measurement of a resin by GPC is performed with a tetrahydrofuran (THF) solvent using HLC-8120 manufactured by Tosoh Corporation and using a TSKgel Super HM-M (15 cm) manufactured by Tosoh Corporation as a column. Next, the molecular weight of the oil is calculated using a calibration curve of molecular weight created with a monodisperse polystyrene standard sample.

The first oil contained in the elastomer particles may be one kind or may be two or more kinds.

The content of the elastomer particles in the toner is preferably from 0.01 mg to 100 mg, more preferably from 0.05 mg to 50 mg, and even more preferably from 0.1 mg to 30 mg, with respect to 1 g of the toner.

In addition, the total content of the first oil in the elastomer particles is preferably from 5% by weight to 40% by weight and more preferably from 10% by weight to 30% by weight, with respect to the entire weight of elastomer.

As a method of measuring the total content of the first oil in the elastomer particles of the toner, after repeating an operation of performing ultrasonic cleaning of the elastomer particles in hexane (at output of 60 W and a frequency of 20 kHz for 30 minutes) and filtering the cleaning solution to remove the first oil, five times, vacuum drying is performed at 60° C. for 12 hours. The content of the first oil in the elastomer particles is calculated from a change in the weights thereof before and after removing the first oil and the total content of the first oil with respect to the 1 g of the toner is calculated from the amount of the elastomer particles added to the toner.

When measuring the amount of the first oil from the toner, the toner is developed and the elastomer particles remains in a developing device for separation, by using characteristics that the elastomer particles do not exhibit a charged state. After stopping supplying of the toner from a cartridge and repeating the printing of an image with Cin 100% of the entire surface to make the toner concentration in the developer close to 0, the developer is taken out and dispersed in a surfactant dispersion, the dispersion is filtered while maintaining a carrier with a magnet, the elastomer particles are collected, and the amount of the elastomer particles in the toner is calculated from the weight. Further, the oil is extracted from the collected elastomer particles and the content of the first oil in the elastomer particles is calculated.

Elastomer Particles

In order to incorporate the first oil into the elastomer particles, the elastomer particles are preferably porous particles having plural holes at least on the surface of each particle, and a specific surface area of the elastomer particles is preferably from 0.1 $m^2/g$ to 25 $m^2/g$, more preferably from 0.3 $m^2/g$ to 20 $m^2/g$, and even more preferably from 0.5 $m^2/g$ to 15 $m^2/g$. When the specific surface area thereof is in the range described above, the elastomer particles easily contain (is easily impregnated with) the first oil.

A method of measuring the specific surface area of the elastomer particles is performed using a BET method.

Specifically, precise weighing of 0.1 g of a measurement sample is performed, put in a sample tube, and subjected to degassing, and the specific surface area is obtained by automatic measurement of a multipoint method, using the elastomer particles separated from the toner and a specific surface area and pores distribution measurement device (SA3100 manufactured by manufactured by Beckman Coulter, Inc.).

The material of the elastomer particles is not particularly limited, as long as it is a material having a property of being deformed due to an external force and being recovered from the deformation, when there is no external force, which is a so-called elastomer, and various well-known elastomers are exemplified. Specific examples thereof include synthetic rubber such as urethane rubber, silicon rubber, fluorine rubber, chloroprene rubber, butadiene rubber, ethylene-propylene-diene copolymer rubber (EPDM), and epichlorohydrin rubber, and a synthetic resin such as polyolefin, a styrene elastomer such as styrene-butadiene rubber, and polyvinyl chloride elastomer.

Among these, silicone rubber and/or a silicone resin are more preferably used, in order to further prevent passing of the toner and formation of white streaks in an image to be obtained.

A number average particle diameter of the elastomer particles is preferably from 1 μm to 30 μm, more preferably from 3 μm to 20 μm, and even more preferably from 5 μm to 20 μm.

By setting the number average particle diameter of the elastomer particles to be equal to or greater than 1 μm, the elastomer particles are rarely attached to the toner particles and fluidity of the toner is hardly deteriorated. In addition, in the development device, pressure from the regulating member (trimmer) is easily received. By setting the number average particle diameter of the elastomer particles to be equal to or smaller than 30 μm, a suitable amount of the first oil in the cleaning blade portion bleeds out and passing of the toner and formation of white streaks of an image to be formed are further prevented.

A volume average particle diameter ($D_{50VE}$) of the elastomer particles and a volume average particle diameter ($D_{50VT}$) of the toner particles preferably satisfy a relationship of the following Expression (1).

$$0.80 < D_{50VE}/D_{50VT} < 2.00 \quad \text{Expression (1)}$$

By setting a value of $D_{50VE}/D_{50VT}$ in the range described above, a suitable amount of the first oil in the cleaning blade portion bleeds out.

The value of $D_{50VE}/D_{50VT}$ shown in the Expression (1) is preferably in a range of 0.90 to 1.80 and more preferably in a range of 1.00 to 1.50.

Regarding the number average particle diameter and the volume average particle diameter of the elastomer particles in the toner, 100 primary particles are observed with a scanning electron microscope (SEM) (S-4100 manufactured by Hitachi, Ltd.), image thereof is captured, this image is put in an image analyzer (LUZEX III manufactured by Nireco Corporation), and a number average particle diameter and a volume average particle diameter of the equivalent circle diameters obtained by the image analysis of the primary particles are calculated. The magnification of the electron microscope is adjusted so that approximately 10 to 50 elastomer particles are contained in 1 visual field and the equivalent circle diameters of the primary particles are determined in combination of observation in plural visual fields.

The content of the elastomer particles is preferably from 0.05 parts by weight to 5 parts by weight, more preferably from 0.1 parts by weight to 3 parts by weight, and even more preferably from 0.1 parts by weight to 2 parts by weight, with respect to 100 parts by weight of the toner particles.

Method of Preparing Elastomer Particles

A method of preparing the elastomer particles is not particularly limited, and a well-known method may be used, and examples thereof include a method of processing elastomer materials into a particular shape, and a method of mixing a pore forming agent with an emulsified particle, performing emulsification polymerization, and removing the pore forming agent, in a case of preparing the elastomer by emulsification polymerization. Among these, the method of mixing a pore forming agent with an emulsified particle, performing emulsification polymerization, and removing the pore forming agent, in a case of preparing the elastomer by emulsification polymerization is preferably used, in order to easily prepare spherical particles.

As the pore forming agent, a compound which is solid at the time of emulsification polymerization and is removed by at least one of dissolving and decomposing after the emulsification polymerization, or a diluent which does not contribute to a polymerization reaction at the time of emulsification polymerization is exemplified.

As the compound which is solid at the time of emulsification polymerization and is removed by at least one of dissolving and decomposing after the emulsification polymerization, calcium carbonate is preferable, in viewpoint of cost and availability. Calcium carbonate has low solubility to water, and dissolves while emitting carbon dioxide, when it contact with an acidic solution.

The diluent is not particularly limited, and diethylbenzene, isoamyl alcohol, and the like are preferably used.

An amount of diluent used is preferably greater than an amount of a polymerizable compound used.

The shape of the pore forming agent is preferably a particular shape, and a number average particle diameter of the pore forming agent is preferably from 5 nm to 200 nm and more preferably from 5 nm to 100 nm.

In addition, conditions of the emulsification polymerization are not particularly limited, and the emulsification polymerization may be performed under conditions of well-known emulsification polymerization, except for using the pore forming agent, for example.

Method of Incorporating First Oil into Elastomer Particles

A method of incorporating the first oil into the elastomer particles is not particularly limited, and a method of bringing the elastomer particles and the first oil to contact with each other, a method of dissolving the first oil in an organic solvent, bringing the solution to contact with the elastomer particles, and removing the organic solvent, and the like are preferably used, for example.

The contacting may be performed in a well-known method, and a method of mixing the elastomer particles and the first oil or a solution of the first oil with each other, or a method of dipping the elastomer particles in the first oil or a solution of the first oil is preferably used, for example.

The organic solvent is not particularly limited, as long as it dissolves the first oil having a reverse polarity to the inorganic particles, and a hydrocarbon solvent or alcohols are preferably used, for example.

Inorganic Particles

The electrostatic charge image developing toner of the exemplary embodiment contains inorganic particles containing the second oil.

Second Oil

The inorganic particles contain the second oil having viscosity equal to or lower than that of the first oil contained in the elastomer particles described above.

The viscosity of the second oil at 25° C. is preferably from 0.03 Pa·s to 1 Pa·s, more preferably from 0.05 Pa·s to 0.8 Pa·s, and even more preferably from 0.1 Pa·s to 0.5 Pa·s.

By setting the viscosity to be equal to or greater than the lower limit, adhesiveness between the toner particles is excellently exhibited. Meanwhile, by setting the viscosity to be equal to or smaller than the upper limit, it is possible to process the inorganic particles to be substantially in a uniform state and excellent fluidity is obtained.

As the second oil contained in the inorganic particles, a compound having a melting point lower than 20° C., that is, a compound which is liquid at 20° C. may be used, and well-known various silicone oil or lubricant is exemplified. In addition, a boiling point of the second oil is preferably equal to or higher than 150° C. and more preferably equal to or higher than 200° C.

As the second oil, silicone oil is particularly preferable.

Examples of silicone oil include silicone oil such as dimethyl polysiloxane, diphenyl polysiloxane, and phenyl methyl polysiloxane, and reactive silicone oil such as amino-modified polysiloxane, epoxy-modified polysiloxane, carboxyl-modified polysiloxane, carbinol modified polysiloxane, fluorine-modified polysiloxane, methacryl-modified polysiloxane, mercapto-modified polysiloxane, and phenol modified polysiloxane. Among these, dimethyl polysiloxane (also referred to as "dimethyl silicone oil") is more preferable.

In addition, examples of the second oil may include oil having positive charging properties such as monoamine-modified silicone oil, diamine-modified silicone oil, amino-modified silicone oil, and ammonium modified silicone oil; and oil having negative charging properties such as dimethyl silicone oil, alkyl-modified silicone oil, α-methyl sulfone-modified silicone oil, chlorophenyl silicone oil, and fluorine-modified silicone oil.

In addition, as the second oil contained in the inorganic particles, oil which is the same type as the first oil contained in the elastomer particles and has different weight average molecular weight is preferably used.

A weight average molecular weight of the second oil is preferably from 1,000 to 20,000 and more preferably from 2,000 to 10,000.

The second oil contained in the inorganic particles may be one kind or may be two or more kinds.

The total content of the second oil in the inorganic particles is preferably from 0.1 mg to 20 mg, more preferably from 1 mg to 10 mg, and even more preferably from 1 mg to 5 mg, with respect to 1 g of the toner.

As a method of measuring the total content of the second oil in the inorganic particles of the toner, after repeating an operation of performing ultrasonic cleaning of the inorganic particles in hexane (at output of 60 W and a frequency of 20 kHz for 30 minutes) and filtering the cleaning solution to remove the second oil, five times, vacuum drying is performed at 60° C. for 12 hours. The content of the second oil in the inorganic particles is calculated from a change in the weights thereof before and after removing the second oil and the total content of the second oil with respect to the 1 g of the toner is calculated from the amount of the inorganic particles added to the toner.

A method of incorporating the second oil into the inorganic particles is performed, for example, by dipping the inorganic particles in the second oil. The amount of the second oil is generally preferably from 1 part by weight to 20 parts by weight with respect to 100 parts by weight of the inorganic particles, for example.

Inorganic Particles

A number average particle diameter of the inorganic particles is preferably from 10 nm to 200 nm.

As the inorganic particles, particles having a number average particle diameter of 10 nm to 30 nm (hereinafter referred to as a small particle diameter external additive) and particles having a number average particle diameter exceeding 30 nm and equal to or smaller than 200 nm (hereinafter referred to as a large particle diameter external additive) may be used in combination.

The combination use of the small particle diameter external additive and the large particle diameter external additive as the inorganic particles is preferable, in order to ensure toner fluidity and to minimize a change in toner fluidity with respect to a stirring stress received in the development device.

The number average particle diameter of the small particle diameter external additive is more preferably in a range of 15 nm to 20 nm.

The number average particle diameter of the large particle diameter external additive is more preferably in a range of 40 nm to 150 nm.

When the small particle diameter external additive and the large particle diameter external additive are used in combination, the second oil may be contained in both or any one of the external additives. Herein, it is more preferable to incorporate the second oil into only the small particle diameter external additive, because adhesiveness may be exhibited only at the time of aggregation.

In a case of using the inorganic particles separated from the toner, the number average particle diameter of the inorganic particles is measured using a Coulter Multisizer II (manufactured by Beckman Coulter, Inc.) When the toner is directly observed, 100 primary particles are observed with a scanning electron microscope (SEM) (S-4100 manufactured by Hitachi, Ltd.) and image thereof is captured, this image is put in an image analyzer (LUZEX III manufactured by Nireco Corporation), and a number average particle diameter of the equivalent circle diameters obtained by the image analysis of the primary particles is calculated. The magnification of the electron microscope is adjusted so that approximately 10 to 50 inorganic particles are shown in 1 visual field and the equivalent circle diameters of the primary particles are determined in combination of observation in plural visual fields.

Examples of the material of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Among these, silica particles are preferable. Examples of silica particles include silica particles such as fumed silica, colloidal silica, and silica gel, and these are used without particular limitation. The silica particles may be used alone or in combination of two or more kinds.

As the small particle diameter external additive in a case of using the small particle diameter external additive and the large particle diameter external additive in combination, $SiO_2$, $TiO_2$, and $Al_2O_3$ are preferable among the materials exemplified above.

As the large particle diameter external additive, $SiO_2$ and $Al_2O_3$ are preferable among the materials exemplified above.

In a case of using the small particle diameter external additive and the large particle diameter external additive in combination and using these without incorporating the second oil into any one of particles, surface treatment (hydrophobizing treatment) may be executed. As the surface treatment, for example, surface treatment using a coupling agent (for example, a silane coupling agent or a titanate coupling agent), fatty acid metal salt, or a charge-controlling agent is exemplified.

The amount of the inorganic particles externally added is, for example, preferably from 0.01% by weight to 5% by weight, and more preferably from 1% by weight to 3.0% by weight with respect to the entire weight of the toner.

In a case of using the small particle diameter external additive and the large particle diameter external additive in combination, the content of the small particle diameter external additive is preferably from 0.01% by weight to 5% by weight and more preferably from 0.1% by weight to 2.0% by weight. Meanwhile, the content of the large particle diameter external additive is preferably from 0.1% by weight to 5% by weight and more preferably from 1.0% by weight to 3.0% by weight.

Other External Additives

The electrostatic charge image developing toner of the exemplary embodiment may contain external additives other than the elastomer particles and the inorganic particles in the surface of the toner mother particles.

The material of the external additive is not particularly limited, and well-known inorganic particles and organic particles are used as external additives of the toner. Examples thereof include inorganic particles such as silica, alumina, titanium oxide (titanium oxide or metatitanic acid), cerium oxide, zirconia, calcium carbonate, magnesium carbonate, calcium phosphate, or carbon black, or resin particles such as a vinyl resin, a polyester resin, or a silicone resin.

Toner Preparing Method

A method of preparing a toner used in the exemplary embodiment will be described.

The toner according to the exemplary embodiment is obtained by externally adding an external additive to toner mother particles after preparing of the toner mother particles.

The toner mother particles may be prepared using any of a dry preparing method (e.g., kneading and pulverization method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner mother particles are preferably obtained by an aggregation and coalescence method.

Specifically, for example, when the toner mother particles are prepared by an aggregation and coalescence method, the toner mother particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner mother particles (coalescence process).

Hereinafter, the respective processes will be described in detail.

In the following description, a method of obtaining toner mother particles containing a colorant and a release agent will be described, but the colorant and the release agent are only used if necessary. Additives other than the colorant and the release agent may also be used.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Herein, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt surfactants, sulfonate surfactants, phosphate surfactants, and soap anionic surfactants; cationic surfactants such as amine salt surfactants and quaternary ammonium salt cationic surfactants; and nonionic surfactants such as polyethylene glycol surfactants, alkyl phenol ethylene oxide adduct surfactants, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to a total amount of the particles is measured as a volume average particle diameter $D_{50v}$. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to acidity (for example, the pH is from 2 to 5), a dispersion stabilizer may be added if necessary, and the heating may then be performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 parts by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner Particles are Obtained Through the Foregoing Processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to the exemplary embodiment is prepared by, for example, adding inorganic particles and further adding and mixing elastomer particles with dry toner particles that have been obtained. The mixing is preferably performed with, for example, a V-blender, a Henschel mixer, a Lodige mixer, or the like. Furthermore, if necessary, coarse toner particles may be removed using a vibration sieving machine, a wind classifier, or the like.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coating carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Method

An image forming apparatus and an image forming method according to the exemplary embodiment will be described.

An image forming method of the exemplary embodiment is not particularly limited, as long as it is an image forming method using the electrostatic charge image developing toner of the exemplary embodiment, and the image forming method is preferably a method which includes a latent image forming process of forming an electrostatic latent image on a surface of an image holding member; a development process of developing the electrostatic latent image formed on the surface of the image holding member with a developer containing a toner and forming a toner image; a transfer process of transferring the toner image to a surface of a transfer medium; a fixing process of fixing the toner image transferred to the surface of the transfer medium; and a cleaning process of cleaning a developer remaining on the image holding member using a cleaning blade, and uses the electrostatic charge image developing toner of the exemplary embodiment as the toner or the electrostatic charge image developer of the exemplary embodiment as the developer.

Each process is a general process. The image forming method of the exemplary embodiment may be performed using an image forming apparatus such as a well-known copying machine or facsimile machine.

The electrostatic latent image forming process is a process of forming an electrostatic latent image on the image holding member (photoreceptor).

The developing process is a process of developing the electrostatic latent image by a developer layer on a developer holding member to form a toner image. The developer layer is not particularly limited, as long as it contains a developer containing the electrostatic charge image developing toner of the exemplary embodiment.

The transfer process is a process of transferring the toner image on a transfer medium. As a transfer medium in the transfer process, an intermediate transfer member or a recording medium such as paper may be exemplified.

In the fixing process, for example, the toner image transferred to the transfer paper is fixed by a heating roller fixing device in which a heating roller temperature is set as a given temperature and the copied image is formed.

The cleaning process preferably includes a process of removing the electrostatic charge image developer remaining on the image holding member using a cleaning blade.

Examples of the material of the cleaning blade preferably include urethane rubber, neoprene rubber, and silicone rubber.

A well known medium may be used as a recording medium, and paper used in electrophotographic copiers or printers or an OHP sheet is used, and for example, coating paper obtained by coating a surface of plain paper with a resin or the like, art paper for printing, and the like are preferably used.

The image forming method of the exemplary embodiment may include a recycling process. The recycling process is a process of moving the electrostatic charge image developing toner collected in the cleaning process to the developer layer. The image forming method including this recycling process is performed using an image forming apparatus such as a toner recycling system type copying machine or a facsimile machine. The cleaning process is omitted, and it is possible to apply to a recycling system having an embodiment of collecting the toner at the same time with the development.

The bleeding amount of the first oil of the elastomer particles in the developing device is determined with the following procedures. After putting a developer in which the elastomer particles are incorporated (toner particles are not contained) in a developing device and driving a developer carrier for 2 hours, the carrier and the elastomer particles are separated from each other by the same method as the method of measuring the total content of the first oil in the elastomer particles. The separated carrier is cleaned with hexane five times to extract oil components to hexane and dried to measure the weight. A value of % by weight of amount of the oil transferred to the surface of the carrier with respect to the amount of the oil contained in the elastomer is defined as a "bleeding amount of the first oil in the developing device".

The bleeding amount of the first oil of the elastomer particles in the cleaning blade portion is determined with the following procedure. After dusting the elastomer particles in front of the cleaning blade and driving a photoreceptor unit for 2 hours, the amount of the oil transferred to the surface of the photoreceptor is extracted and quantitated, and a value of % by weight of amount of the oil transferred to the surface of the photoreceptor with respect to the amount of the oil contained in the elastomer is defined as a "bleeding amount of the first oil in the cleaning blade portion".

Regarding the elastomer particles used in the toner of the exemplary embodiment, the amount of the first oil in the developing device is smaller than 30% by weight and the amount of the first oil in the cleaning blade portion is preferably equal to or greater than 30% by weight.

In the image forming method of the exemplary embodiment, the amount of the first oil of the elastomer particles in the developing device is smaller than 30% by weight and the amount of the first oil in the cleaning blade portion is preferably equal to or greater than 30% by weight.

The amount of the first oil in the developing device may be adjusted by a particle diameter of the carrier and an elastic modulus of a silicone elastomer.

The amount of the first oil in the cleaning blade portion may be adjusted by a protruding amount and/or an angle of the cleaning blade or an elastic modulus of a silicone elastomer.

Image Forming Apparatus

An image forming apparatus of the exemplary embodiment may include a developing unit which develops an electrostatic latent image by the electrostatic charge image developer of the exemplary embodiment to form a toner image and is preferably an apparatus which includes an image holding member; a charging unit which charges the image holding member; an exposure unit which exposes the charged image holding member to form an electrostatic latent image on the surface of the image holding member; a developing unit which develops the electrostatic latent image by a developer containing the toner to form a toner image; a transfer unit which transfers the toner image to a surface of a transfer medium from the image holding member; a fixing unit which fixes the toner image transferred to the surface of the transfer medium; and a cleaning unit which cleans the image holding member using a cleaning blade as a unit of the cleaning unit, in which the toner is the electrostatic charge image developing toner of the exemplary embodiment or the developer is the electrostatic charge image developer of the exemplary embodiment.

FIG. 1 is schematic diagram showing a configuration of a quadruple tandem system color image forming apparatus. The image forming apparatus shown in FIG. 1 is provided with first to fourth electrophotographic image forming units 10Y, 10M, 100, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side. Developing devices (developing units) 4Y, 4M, 4C, and 4K of the units 10Y, 10M, 10C, and 10K are supplied with toner including four color toner, that is, a yellow toner, a magenta toner, a cyan toner, and a black toner contained in toner cartridges 8Y, 8M, 8C, and 8K, respectively.

The first to fourth units 10Y, 10M, 10C, and 10K described above have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member (photoreceptor). Around the photoreceptor 1Y, a charging roll (charging device and charging unit) 2Y that charges a surface of the photoreceptor 1Y to a predetermined potential, an exposure device (exposure unit) 3 that exposes the charged surface with laser beams 3Y based on a color-separated image signal to form an electrostatic charge image, a developing device (developing unit) 4Y that supplies a charged toner to the electrostatic charge image to develop the electrostatic charge image, a primary transfer roll (primary transfer unit) 5Y that transfers the developed toner image onto the intermediate transfer belt 20, and a cleaning device (cleaning unit) 6Y that removes the toner remaining on the surface of the photoreceptor 1Y after primary transfer by the cleaning blade, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described. First, before the operation, the surface of the photoreceptor 1Y is charged by the charging roll 2Y. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow printing pattern is formed on the surface of the photoreceptor 1Y. Thus, the electrostatic charge image formed on the photoreceptor 1Y is rotated up to a predetermined developing position with the travelling of the photoreceptor 1Y. The electrostatic charge image on the photoreceptor 1Y is visualized (a developed image and a toner image) at the developing position by the developing device 4Y.

The developing device 4Y accommodates, for example, the electrostatic charge image developer of the exemplary embodiment including at least a yellow toner and a carrier. By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. On the other hand, the toner remaining on the photoreceptor 1Y is removed and collected by the cleaning unit 6Y including the cleaning blade.

The primary transfer biases that are applied to the primary transfer rolls 5M, 5C, and 5K of the second unit 10M and the subsequent units are also controlled in the same manner as in the case of the first unit. In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (the secondary transfer unit) 26 disposed on the image holding surface side of the intermediate transfer belt 20. Meanwhile, a recording sheet (the transfer medium) P is supplied to a gap between the secondary transfer roll 26 and the intermediate transfer belt 20, that are brought into contact with each other, via a supply mechanism at a predetermined timing, a secondary transfer bias is applied to the support roll 24, and the toner image on the intermediate transfer belt 20 is transferred onto the recording sheet P.

Thereafter, the recording sheet P is transported to a pressure-contacting part (nip part) between a pair of fixing rolls in a fixing device (roll-shaped fixing unit) 28, the toner image heated, the colored toner image is melted and is fixed onto the recording sheet P. The recording sheet P on which the fixing of the color image is completed is discharged toward a discharge part, and a series of the color image forming operations end.

The image forming apparatus of the exemplary embodiment is not particularly limited as long as it includes at least the image holding member, the charging unit, the exposing unit, the developing unit, the transfer unit, and the cleaning unit, and may include the fixing unit or an erasing unit, if necessary.

In the transfer unit, the transfer is performed two or more times using an intermediate transfer member. An intermediate transfer member or a recording medium such as paper is exemplified as the transfer medium in the transfer unit.

In the image holding member and each unit described above, it is possible to preferably use a configuration including each process of the image forming method. As each unit, a well-known unit may be used in an image forming apparatus. The image forming apparatus of the exemplary embodiment may include units or apparatus other than the configuration described above. The image forming apparatus of the exemplary embodiment may be operated at the same time with plural units.

In addition, in the image forming apparatus of the exemplary embodiment, it is preferable to include the cleaning unit which removes the electrostatic charge image developer remaining on the image holding member by the cleaning blade.

Toner Cartridge, Developer Cartridge, Process Cartridge

The toner cartridge of the exemplary embodiment is a toner cartridge which accommodates at least the electrostatic charge image developing toner of the exemplary embodiment.

A developer cartridge of the exemplary embodiment is a developer cartridge which accommodates at least the electrostatic charge image developer of the exemplary embodiment.

A process cartridge of the exemplary embodiment includes at least one kind selected from a group consisting of a developing unit which develops an electrostatic latent image formed on a surface of an image holding member by the electrostatic charge image developing toner or the electrostatic charge image developer to form a toner image, the image holding member, a charging unit which charges the surface of the image holding member, and a cleaning unit for removing toner remaining on the surface of the image holding member, and accommodates at least the electrostatic charge image developing toner of the exemplary embodiment or the electrostatic charge image developer of the exemplary embodiment.

It is preferable that the toner cartridge of the exemplary embodiment is detachable from the image forming apparatus. That is, the toner cartridge of the exemplary embodiment accommodating the toner of the exemplary embodiment is preferably used in the image forming apparatus from which the toner cartridge is detachable.

The developer cartridge of the exemplary embodiment is not particularly limited, as long as it contains the electrostatic charge image developer containing the electrostatic charge image developing toner of the exemplary embodiment. The developer cartridge is, for example, detachable from the image forming apparatus including the developing unit and accommodates the electrostatic charge image developer containing the electrostatic charge image developing toner of the exemplary embodiment as a developer to be supplied to the developing unit.

The developer cartridge may be a cartridge which accommodates a toner and a carrier or a cartridge which accommodates only a toner and a cartridge which accommodates only a carrier may be separately provided.

It is preferable that the process cartridge of the exemplary embodiment is detachable from the image forming apparatus.

In addition, the process cartridge of the exemplary embodiment may include an erasing unit and other members, if necessary.

The toner cartridge and the process cartridge may have a well-known configuration.

EXAMPLES

Hereinafter, the exemplary embodiment will be described in more detail using examples and comparative examples, but is not limited to these examples. Unless specifically noted, "parts" and "%" mean "parts by weight" and "% by weight".

The viscosity of the first oil or the second oil, the particle diameter of the elastomer particles, and the particle diameter of the toner mother particles are measured by the method described above.

Preparation of Elastomer Particles 1

100 parts of methylvinyl polysiloxane and 10 parts of methylhydrogen polysiloxane are mixed with each other, 30 parts of calcium carbonate powder (number average particle diameter of 0.1 μm, TP-123 manufactured by Okutama Kogyo CO., LTD.), 1 part of polyoxyethylene octylphenyl ether, and 200 parts of water are added to the mixture, the mixture is emulsified using a mixer at 6,000 rpm for 3 minutes, 0.001 parts of chloroplatinic acid-olefin complex salt in terms of an amount of platinum is added thereto, and polymerization reaction is conducted under a nitrogen atmosphere at 80° C. for 10 hours. After that, hydrochloric acid is added to decompose calcium carbonate, and then water washing is performed. In addition, wet classification is performed to select elastomer particles having a desired volume average particle diameter ($D_{50VE}$) and vacuum drying is conducted at 100° C. for 12 hours.

After that, 150 parts of dimethyl silicone oil (PDMS, viscosity μVE (25° C.) 100 mPa·s) is dissolved in 1,000 parts of ethanol, 100 parts of the elastomer particles are mixed therewith and stirred, ethanol of the solvent is distilled away using an evaporator, the resultant material is dried, and thus, elastomer particles 1 treated with oil are obtained.

Preparation of Elastomer Particles 2

Elastomer particles 2 are prepared in the same manner as in the preparation of the elastomer particles 1, except for conducting the polymerization reaction at 80° C. for 7 hours.

Preparation of Elastomer Particles 3

Elastomer particles 3 are prepared in the same manner as in the preparation of the elastomer particles 1, except for conducting the polymerization reaction at 85° C. for 10 hours.

Preparation of Elastomer Particles 4

Elastomer particles 4 are prepared in the same manner as in the preparation of the elastomer particles 1, except for conducting the polymerization reaction at 85° C. for 12 hours.

Preparation of Elastomer Particles 5

Elastomer particles 5 are prepared in the same manner as in the preparation of the elastomer particles 1, except for not performing the process regarding the treatment of dimethyl silicone oil.

Preparation of Crystalline Polyester Resin Dispersion 45 parts by mol of 1,9-nonanediol, 55 parts by mol of dodecanedicarboxylic acid, and 0.05 parts by mol of dibutyl tin oxide as a catalyst are added in a heated and dried three-necked flask, air in the vessel is turned into an inert atmosphere with nitrogen gas by performing pressure reducing operation, the mixture is stirred and refluxed by mechanical stirring at 180° C. for 2 hours. After that, the temperature is slowly increased to 230° C. under the reduced pressure, the mixture is stirred for 5 hours. At the time when a viscous state is obtained, the mixture is cooled and the reaction is stopped, and thus, a crystalline polyester resin is synthesized. The weight average molecular weight (Mw) of the obtained crystalline polyester resin is measured by gel permeation chromatography (polyester conversion), it is 25,000. Then, 3,000 parts of the obtained crystalline polyester resin, 10,000 parts of ion exchange water, and 90 parts of surfactant sodium dodecylbenzenesulfonate are added to a emulsification tank of a high temperature and high pressure emulsification device (Cavitron CD1010, slit: 0.4 mm), heated and melted at 130° C., dispersed at 110° C., a flow rate of 3 L/m, and 10,000 rotations for 30 minutes, and is allowed to pass a cooling tank to collect a crystalline polyester resin dispersion (high temperature and high pressure emulsification device (Cavitron CD1010, slit: 0.4 mm, manufactured by Eurotec Ltd.)), and thus, the crystalline polyester resin dispersion is obtained.

Preparation of Amorphous Polyester Resin Dispersion 15 parts by mol of polyoxyethylene (2,0)-2,2-bis (4-hydroxyphenyl) propane, 85 parts by mol of polyoxypropylene (2,2)-2,2-bis (4-hydroxyphenyl) propane, 10 parts by mol of terephthalic acid, 67 parts by mol of fumaric acid, 3 parts by mol of n-dodecenylsuccinic acid, 20 parts by mol of trimellitic acid, and dibutyl tin oxide, the amount of which is 0.05 parts by mol with respect to the above acid components (total mole number of terephthalic acid, fumaric acid, n-dodecenylsuccinic acid, and trimellitic acid) are put into a vessel, nitrogen gas is introduced into the vessel to maintain the air in an inert atmosphere and the temperature is increased to perform co-polycondensation at 150° C. to 230° C. for 12 hours to 20 hours. After that, the pressure is slowly reduced at 210° C. to 250° C., and thus, the amorphous polyester resin is synthesized. The weight average molecular weight Mw of the resin is 65,000. Then, 3,000 parts of the obtained amorphous polyester resin, 10,000 parts of ion exchange water, and 90 parts of surfactant sodium dodecylbenzenesulfonate are added to a emulsification tank of a high temperature and high pressure emulsification device (Cavitron CD1010, slit: 0.4 mm), heated and melted at 130° C., dispersed at 110° C., a flow rate of 3 L/m, and 10,000 rotations for 30 minutes, and is allowed to pass a cooling tank to collect an amorphous polyester resin dispersion (high temperature and high pressure emulsification device (Cavitron CD1010, slit: 0.4 mm, manufactured by Eurotec Ltd.)), and thus, the amorphous polyester resin dispersion is obtained.

Preparation of Colorant Dispersion

Cyan pigment (copper phthalocyanine, C.I. Pigment Blue 15:3 manufactured by Dainichiseika Color & Chemicals Mfg. Co., Ltd.): 1,000 parts Ionic surfactant NEOGEN RK (manufactured by Dai-Ichi Kogyo Seiyaku Co., Ltd.): 150 parts Ion exchange water: 4,000 parts The above components are mixed, dissolved, and dispersed using a high-pressure impact type disperser ULTIMIZER (HJP30006 manufactured by SUGINO MACHINE LIMITED) for 1 hour, and thus, a cyan colorant dispersion having a volume average particle diameter of 180 nm and a solid content of 20% is obtained.

Preparation of Release Agent Dispersion

Paraffin Wax HNP9 (melting temperature of 75° C.: manufactured by Nippon Seiro Co., Ltd.): 46 parts Cationic surfactant NEOGEN RK (manufactured by Dainichiseika Color & Chemicals Mfg. Co., Ltd.): 5 parts Ion exchange water: 200 parts The above materials are heated to 100° C., sufficiently dispersed using Ultra Turrax T50 manufactured by IKA Japan, K.K., and dispersed using a pressure discharge type Gaulin homogenizer, and thus, a release agent dispersion having a center diameter of 200 nm and solid content of 20.0% is obtained.

Preparation of Toner Mother Particles 1

Amorphous polyester resin dispersion: 256.8 parts

Crystalline polyester resin dispersion: 33.2 parts

Colorant dispersion: 27.4 parts

Release agent dispersion: 35 parts

The above materials are sufficiently mixed and dispersed in a round stainless steel flask using Ultra Turrax T50. Then, 0.20 parts of polyaluminum chloride is added thereto and the dispersion operation is continued using Ultra Turrax. The flask is heated to 48° C. while stirring in an oil bath for heating, and maintained at 48° C. for 60 minutes (aggregation process). Then, 70.0 parts of the amorphous polyester resin dispersion is added thereto. Then, after adjusting the pH in the system to 8.0 using sodium hydroxide aqueous solution having a concentration of 0.5 mol/L, the stainless steel flask is sealed, heated to 96° C. while continuing stirring using magnetic seal, and kept for 3 hours (coalescence process). After the reaction ends, the mixture is cooled, filtered, and sufficiently washed with ion exchange water, and solid-liquid separation is performed by Nutsche-type suction filtration. In addition, the solid content is dispersed again using 1,000 parts of ion exchange water at 30° C., stirred and washed at 300 rpm for 15 minutes. This operation is further repeated five times. At the time when the pH of the filtrate is 7.5 and electrical conductivity is 7.0 μS/cm, the solid-liquid separation is performed by Nutsche-type suction filtration using No. 5A filter paper. Next, vacuum drying is continued for 12 hours. At that time, the particle diameter is measured with a Coulter Multisizer II (manufactured by Beckman Coulter, Inc.), and as a result thereof, the volume average particle diameter thereof is 4.0 μm.

Preparation of Toner Mother Particles 2

Toner mother particles 2 are prepared in the same manner as in the preparation of the toner mother particles 1 except for setting the maintaining conditions in the aggregation process to 50° C. and 80 minutes.

Preparation of Inorganic Particles 1

10 parts of dimethyl silicone oil (PDMS, viscosity μVA (25° C.) 50 mPa·s) is added to 100 parts of silica (AEROSIL (registered trademark) 200 manufactured by Nippon Aerosil co. Ltd.) and further stirred for 15 minutes. Finally the temperature is increased to 90° C., ethanol is dried under the reduced pressure, a processed material is taken out, and vacuum drying is further performed at 120° C. for 30 minutes. The dried silica is pulverized to thereby obtain inorganic particles having a number average particle diameter of 15 nm.

Preparation of Inorganic Particles 2

Inorganic particles 2 are prepared in the same manner as in the preparation of the inorganic particles 1, except for using dimethyl silicone oil (PDMS, viscosity μVA (25° C.) 100 mPa·s).

Preparation of Inorganic Particles 3

Inorganic particles 3 are prepared in the same manner as in the preparation of the inorganic particles 1, except for using methylphenyl silicone (PhMS, viscosity μVA (25° C.) 100 mPa·s).

Preparation of Inorganic Particles 4

Inorganic particles 4 are prepared in the same manner as in the preparation of the inorganic particles 1, except for using dimethyl silicone oil (PDMS, viscosity μVA (25° C.) 300 mPa·s).

Preparation of Carrier

- Ferrite particles: 100 parts (Mn—Mg ferrite, volume average particle diameter of 35 μm)
- A methyl methacrylate (MMA)/dimethylaminoethyl methacrylate (DMAEMA) copolymer (specific resin, copolymerization molar ratio 95:5, Mw: 49,000): 3 parts
- Carbon black (VXC-72 manufactured by Cabot Corporation): 0.3 parts
- Toluene: 14 parts Among the above components, the components excluding the ferrite particles and glass beads (φ1 mm, same amount as toluene) are stirred at 1,200 ppm for 30 minutes using a sand mill (batch type sand mill) manufactured by Kansai Paint Co., Ltd. to thereby prepare a coating film forming solution.

This coating film forming solution and the ferrite particles are added in a vacuum degassing type kneader, toluene is removed by reducing the pressure, and thus, the coating film is formed on the ferrite particle surface. Then, fine powder and coarse powder are removed by an elbow jet to thereby obtain a carrier.

Example 1

Preparation of Toner 0.5 parts of the elastomer particles 1 and 1.5 parts of the inorganic particles 1 are mixed with 100 parts of the toner mother particles 1 using a Henschel mixer at 10,000 rpm for 30 seconds, and sieved using a vibrating sieve having an aperture of 45 μm, and thus, a toner of Example 1 is prepared.

Preparation of Developer 100 parts of the carrier and 10 parts of the toner of Example 1 are stirred at 40 rpm for 20 minutes using a V-blender, and passed through a sieve screen having mesh having a size of 106 μm, and thus, a developer of Example 1 is obtained.

Examples 2 to 10 and Comparative Examples 1 to 3

Developers of Examples 2 and 6 to 10 and Comparative Examples 1 to 3 are respectively prepared in the same manner as in Example 1, except for changing the toner mother particles, the elastomer particles, and/or the inorganic particles as shown in Table 1.

Developers of Examples 3 to 5 are respectively prepared in the same manner as in Example 1, except for changing toner mother particles, the elastomer particles, the inorganic particles, and/or a system configuration as shown in Table 1.

System Configuration

A state where a trimmer gap of a developing device of DoCuCentre-III C7600 manufactured by Fuji Xerox Co., Ltd. is set as 0.5 mm and a protruding amount of the cleaning blade is an initial set value, is set as a system configuration 1.

The same configuration as the system configuration 1 except for setting the trimmer gap as 0.3 mm is set as a system configuration 2.

The same configuration as the system configuration 2 except for shortening the protruding amount of the cleaning blade by 1 mm is set as a system configuration 3.

The same configuration as the system configuration 3 except for setting the trimmer gap as 0.2 mm is set as a system configuration 4.

The system configurations used in examples and comparative examples are shown in Table 1.

Evaluation of Bleeding Amount of Oil 100 parts of the carrier and 1 part of the elastomer particles are mixed with each other and put in the developing device, the developer holding member is driven for 2 hours, the oil particles transferred to the carrier are quantitated, and the bleeding amount of the developing device is calculated.

After dusting 0.5 g of the elastomer particles in front of the cleaning blade and driving a photoreceptor unit for 2 hours, the amount of the oil transferred to the surface of the photoreceptor is extracted and quantitated, the bleeding amount of the cleaning blade portion (BLD portion) is calculated.

Evaluation of Toner Passing and Formation of White Streaks

A developing device of DocuCentre-III C7600 manufactured by Fuji Xerox Co., Ltd. is filled with the developer which is a sample and 5 sets of printing are repeatedly performed under Conditions B described below.

Conditions A: respective 5,000 sheets of images having image density of 1%, 30%, 0.5%, and 50% are repeatedly printed 5 times.

Conditions B: printing under the conditions A is performed under conditions of an environment of 30° C./85% RH and an environment of 5° C./10% RH, respectively.

Evaluation Criteria

The subsequent 100 sheets of the printed images are checked each time the image density is changed, toner passing and formation or non-formation of white streaks are checked, and whether the confirmed streaks do not disappear even in the subsequent scanning is determined with the following evaluation criteria.

A: no toner passing and no formation of white streaks are observed until the completion of printing of the fifth set.

B: toner passing and formation of white streaks are observed while completing the printing of the fifth set, but both of them disappear by the printing 100 or less sheets after the observation.

C: toner passing and formation of white streaks are observed while completing the printing of the fifth set and do not disappear by the subsequent printing.

D: toner passing and formation of white streaks are observed while completing the printing of the fourth set and do not disappear by the subsequent printing.

Evaluation results of examples and comparative examples are shown in Table 1.

TABLE 1

| | | Elastomer particles | | | Inorganic particles | | | Toner mother particles | | Parameter | | System configuration No. | Evaluation results | | |
|---|---|---|---|---|---|---|---|---|---|---|---|---|---|---|---|
| | | No. | Particle diameter $D_{50VE}$ (μm) | Oil viscosity $\mu_{VE}$ (mPa · s) | Oil type | No. | Oil viscosity $\mu_{VA}$ (mPa · s) | Oil type | No. | Particle diameter $D_{50VT}$ (μm) | $\mu_{VA}/\mu_{VE}$ | $D_{50VE}/D_{50VT}$ | | Bleeding amount in developing device (%) | Bleeding amount in BLD portion (%) | Evaluation of passing of toner and formation of white streaks |
| Ex. | 1 | 1 | 5.1 | 100 | PDMS | 1 | 50 | PDMS | 1 | 4.0 | 0.5 | 1.28 | 1 | 24 | 33 | A |
| | 2 | 1 | 5.1 | 100 | PDMS | 2 | 100 | PDMS | 1 | 4.0 | 1.0 | 1.28 | 1 | 24 | 33 | A |
| | 3 | 1 | 5.1 | 100 | PDMS | 1 | 50 | PDMS | 1 | 4.0 | 0.5 | 1.28 | 2 | 28 | 33 | B |
| | 4 | 1 | 5.1 | 100 | PDMS | 1 | 50 | PDMS | 1 | 4.0 | 0.5 | 1.28 | 3 | 28 | 30 | B |
| | 5 | 1 | 5.1 | 100 | PDMS | 1 | 50 | PDMS | 1 | 4.0 | 0.5 | 1.28 | 4 | 31 | 29 | C |
| | 6 | 1 | 5.1 | 100 | PDMS | 3 | 100 | PhMS | 1 | 4.0 | 0.5 | 1.28 | 1 | 24 | 33 | B |
| | 7 | 1 | 5.1 | 100 | PDMS | 1 | 50 | PDMS | 2 | 6.2 | 0.5 | 0.82 | 1 | 24 | 33 | B |
| | 8 | 2 | 4.5 | 100 | PDMS | 1 | 50 | PDMS | 2 | 6.2 | 0.5 | 0.73 | 1 | 28 | 33 | B |
| | 9 | 3 | 7.0 | 100 | PDMS | 1 | 50 | PDMS | 1 | 4.0 | 0.5 | 1.75 | 1 | 22 | 35 | B |
| | 10 | 4 | 8.5 | 100 | PDMS | 1 | 50 | PDMS | 1 | 4.0 | 0.5 | 2.13 | 1 | 21 | 31 | C |
| Com. | 1 | 1 | 5.1 | 100 | PDMS | — | — | — | 1 | 4.0 | — | 1.28 | 1 | 24 | 33 | D |
| Ex. | 2 | 5 | 5.1 | — | — | 2 | 100 | PDMS | 1 | 4.0 | — | 1.28 | 1 | 0 | 0 | D |
| | 3 | 1 | 5.1 | 100 | PDMS | 4 | 300 | PDMS | 1 | 4.0 | 3.0 | 1.28 | 1 | 24 | 33 | D |

In Table 1, "-" in a No. column of the inorganic particles indicates that no inorganic particles are externally added in the corresponding example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner mother particles containing at least a binder resin;

elastomer particles comprising a first oil; and inorganic particles comprising a second oil, wherein:

a viscosity of the first oil is higher than a viscosity of the second oil, the first and second oils comprise polydimethyl silicone oil (PDMS), the elastomer particles comprise at least one particle comprising a synthetic rubber or a synthetic resin, and the inorganic particles comprise at least one particle comprising $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $Al_2O_3.2SiO_2$, $CaCO_3$, $MgCO_3$, $BaSO_4$,or $MgSO_4$.

2. The electrostatic charge image developing toner according to claim 1, wherein a volume average particle diameter ($D_{50VE}$) of the elastomer particles and a volume average particle diameter ($D_{50VT}$) of the toner mother particles satisfy a relationship of the following Expression (1):

$$0.80<D_{50VE}/D_{50VT}<2.00 \quad (1).$$

3. The electrostatic charge image developing toner according to claim 1, wherein the first oil and the second oil are comprised of the same type of oils.

4. The electrostatic charge image developing toner according to claim 1, wherein the first oil further comprises silicone oil.

5. The electrostatic charge image developing toner according to claim 1, wherein the second oil further comprises silicone oil.

6. The electrostatic charge image developing toner according to claim 1, wherein the elastomer particles are particles of a silicone rubber and/or a silicone resin.

7. The electrostatic charge image developing toner according to claim 1, wherein the toner has a shape factor SF1 of from 110 to 150.

8. The electrostatic charge image developing toner according to claim 1, wherein a viscosity of the first oil at 25° C. is from 10 mPa·s to 500 mPa·s.

9. The electrostatic charge image developing toner according to claim 1, wherein a weight average molecular weight of the first oil is from 2,000 to 30,000.

10. The electrostatic charge image developing toner according to claim 1, wherein a content of the elastomer particles is from 0.01 mg to 100 mg with respect to 1 g of the toner.

11. The electrostatic charge image developing toner according to claim 1, wherein a total content of the first oil in the elastomer particles is from 5% by weight to 40% by weight with respect to a total amount of the elastomer particles.

12. The electrostatic charge image developing toner according to claim 1, wherein a specific surface area of the elastomer particles is from 0.1 $m^2/g$ to 25 $m^2/g$.

13. The electrostatic charge image developing toner according to claim 1, which comprises, as the inorganic particles, particles having a number average particle diameter of 10 nm to 30 nm and particles having a number average particle diameter exceeding 30 nm and equal to or smaller than 200 nm in combination.

14. An electrostatic charge image developer comprising:

the electrostatic charge image developing toner according to claim 1; and a carrier.

15. A toner cartridge that is detachable from an image forming apparatus and accommodates the electrostatic charge image developing toner according to claim 1.

* * * * *